US005593039A

United States Patent [19]

Ortlieb

[11] Patent Number: 5,593,039

[45] Date of Patent: Jan. 14, 1997

[54] CORNER POST FOR PACKAGING SYSTEM

[75] Inventor: Orlen J. Ortlieb, Antioch, Tenn.

[73] Assignee: Sonoco Products Compnay, Hartsville, S.C.

[21] Appl. No.: 562,027

[22] Filed: Nov. 22, 1995

[51] Int. Cl.[6] ..... B65D 81/02

[52] U.S. Cl. ..... 206/586; 206/320; 206/453

[58] Field of Search ..... 206/521, 320, 206/453, 586, 587, 591–594

[56] References Cited

U.S. PATENT DOCUMENTS

| | | | |
|---|---|---|---|
| 3,072,313 | 1/1963 | Svendsen | 206/320 |
| 3,351,189 | 11/1967 | Hoth | 206/320 |
| 3,363,749 | 1/1968 | Tinapple | 206/320 |
| 3,891,086 | 6/1975 | Isaacs | 206/320 |
| 4,483,444 | 11/1984 | Gardner | 206/594 |
| 4,811,840 | 3/1989 | Muyskens | 206/320 |
| 5,267,651 | 12/1993 | Hughes | 206/586 |

*Primary Examiner*—Bryon P. Gehman
*Assistant Examiner*—Luan Z. Bui
*Attorney, Agent, or Firm*—Dennison, Meserole, Pollack & Scheiner

[57] ABSTRACT

A corner support post formed from a paperboard tube includes a substantially planar outer wall and an inner wall coextensive therewith and provided with a shoulder defined by a laterally turned portion of the inner wall. A compression accommodating bead is formed from the outer wall and extends into engagement with the inner wall between the shoulder and a first end wall extending between the outer and inner walls. A second end wall, opposed from the first end wall, extends between the outer and inner walls with the outer wall, from the shoulder, inclining toward the outer wall and terminating at the second end wall.

5 Claims, 2 Drawing Sheets

Fig. 1
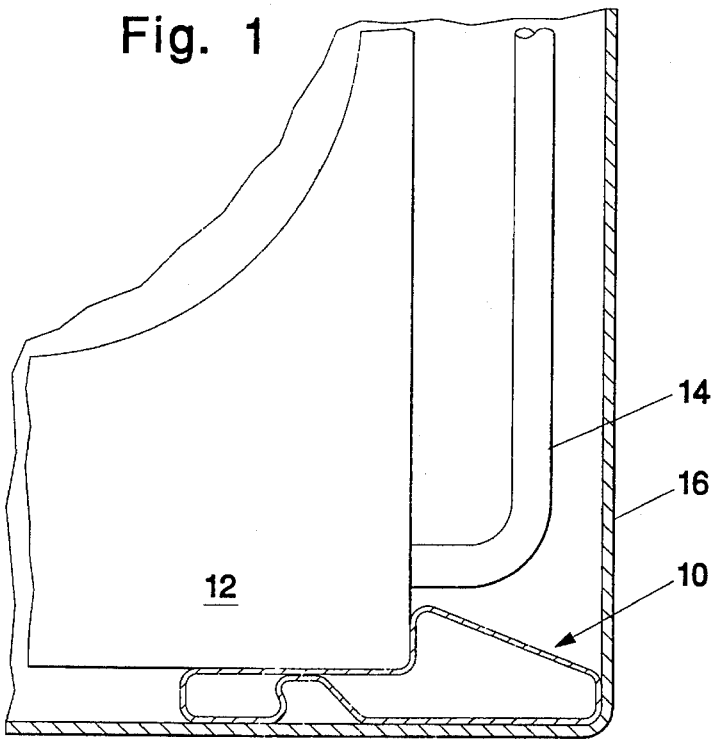
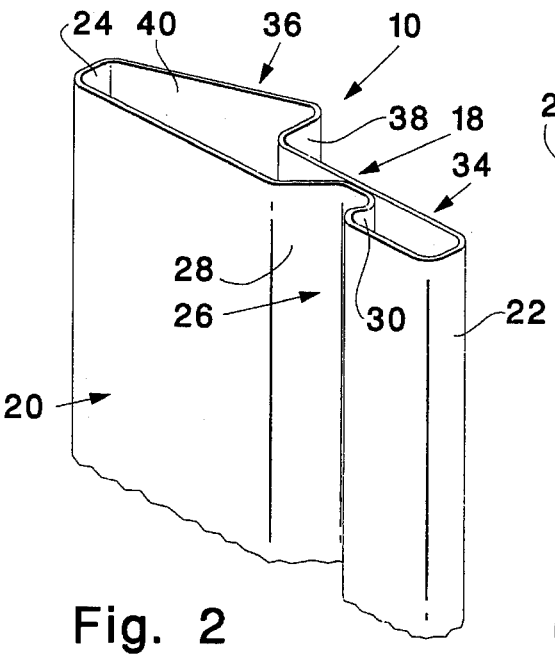
Fig. 2
Fig. 3
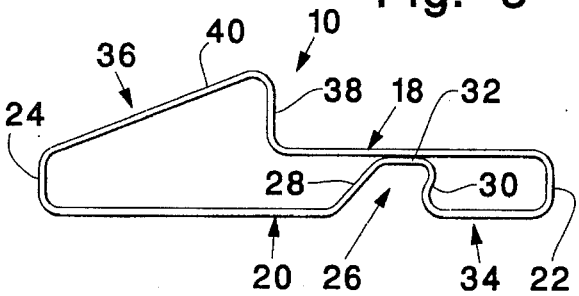
Fig. 4
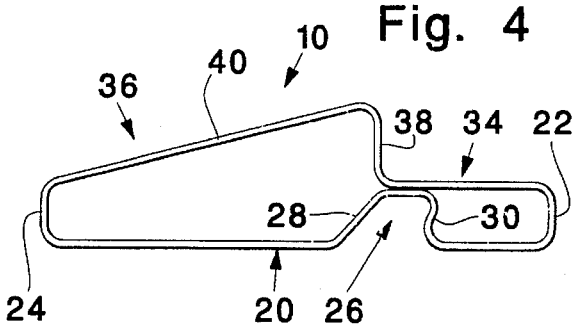

CORNER POST FOR PACKAGING SYSTEM

BACKGROUND OF THE INVENTION

In the packaging of heavy home appliances, for example dishwashers, refrigerators, ranges and the like, a preferred procedure utilizes spaced support posts, normally at the corners of the appliance, which extend at least the full height of the appliance and are in turn enclosed by a protective sleeve or carton of corrugated cardboard. Heavy duty plastic wrap can also be used.

It is the support or corner posts themselves which protect the appliance against damage at the more vulnerable edges of the product with the packaging sleeve of corrugated cardboard or the like stabilizing and assisting in maintaining the position of the corner posts, while at the same time also protecting the product against incidental scratches, dents, and the like during shipping and storage.

Corner posts of the type herein involved are conventionally formed of convolutely wound paperboard tubes which are transversely formed to the desired post configuration. Such tube-formed support posts are considered particularly desirable in light of the substantial strength achieved and the economies derived from both using an inexpensive basic material and simplified manufacturing procedures requiring only the controlled deformation of a conventionally formed convolute tube prior to a final curing of the resins or adhesives between the plies of paperboard.

A preferred form of such a tube will be seen in U.S. Pat. No. 5,267,651, commonly assigned with the present invention. While the support post of this patent constitutes a significant advance over what had gone before, as specifically detailed in the patent, particular appliances have been found to require support post protection beyond that provided by the patented post. More particularly, and as an example a refrigerator may include, outward of the main structural box, a projecting door handle to the front thereof and an external mounted condenser on the back. The "L" post of the prior patent normally does not, in itself, provide sufficient clearage for such projecting components. Rather, it has been found necessary to provide additional cushioning, for example utilizing two stacked prior art posts to extend beyond and accommodate the projecting components. This could affect the stability of the support system and clearly increases material and handling costs.

SUMMARY OF THE INVENTION

The present invention is specifically concerned with a corner support post which, as a unitary member, protects the corner of the appliance, provides the desired strength and support required, provides a novel integral extension to extend beyond and protect external components, and, in the manner of the "L" support of U.S. Pat. No. 5,267,651, provide an enhanced cushioning effect. In light of common ownership, and the background material in U.S. Pat. No. 5,267,651, the disclosure of that patent is herein incorporated by reference.

It is intended that the corner post of the invention, with the integral protective extension, be adapted to corner mount with the extension protruding beyond any side of the normally rectangular appliance, that is to the front or rear thereof, or to either side thereof. When so mounted, the post effectively encloses the corner for protection thereof as is the goal of the conventional corner post. At the same time, the post accommodates projecting components, offsets in the body of the appliance, such as in built-in dishwashers wherein the back is normally narrower than the front, and like situations without the necessity of stacking corner posts, adding additional spacers, and the like.

Structurally, the corner post of the invention is preferably formed from a convolutely wound paperboard tube transversely formed to the desired post configuration. The formed corner post having first and second substantially coextensive side walls includes a first cushioning section similar to one leg of the post in U.S. Pat. No. 5,267,651 and similarly adapted to lie against one side of the appliance adjacent a corner thereof. This first portion will include a collapsible bead foldable, upon being subject to excess pressure, to provide a multi-layered configuration which maintains a desired cushioning effect for the product.

A second extension section, integral with the first section, aligns therewith and extends in what might be considered a linear direction therefrom a sufficient distance therebeyond as to clearly accommodate the external projection or projections of the particular appliance to be protected. The extension section includes a laterally outwardly projecting shoulder thereon, which may in fact generally transversely align with the adjacent side of the bead of the first section. This shoulder seats against the appliance corner at right angles to the first section and against that side of the appliance from which the component extends. The extension section, with a tapering configuration, extends outwardly or forwardly from the shoulder a distance sufficiently beyond the extension of the appliance component to clearly outwardly space the encircling cardboard sleeve or the like and provide for a substantial degree of compression between the outer extremity of the support and the outer extremity of the projecting component on the appliance. Formed in this manner, the corner post of the invention both completely protects the corner, providing the desired vertical and transverse support, and at the same time effectively protects appliance handles, condensers, and the like.

Additional features and advantages of the invention will become apparent from the detailed description following hereinafter.

BRIEF DESCRIPTION OF THE DRAWINGS

FIG. 1 is a sectional detail illustrating the positioning of the corner post with the product in the package having a forwardly projecting handle, as in a range;

FIG. 2 is a perspective view of the upper portion of the corner post, the length of which will vary in accord with the height of the appliance and normally will be approximately three quarter inch to one inch taller than the height of the appliance;

FIG. 3 is a top plan view of the corner post;

FIG. 4 is a top plan view of a variation of the corner post;

DESCRIPTION OF PREFERRED EMBODIMENTS

Figure 5:
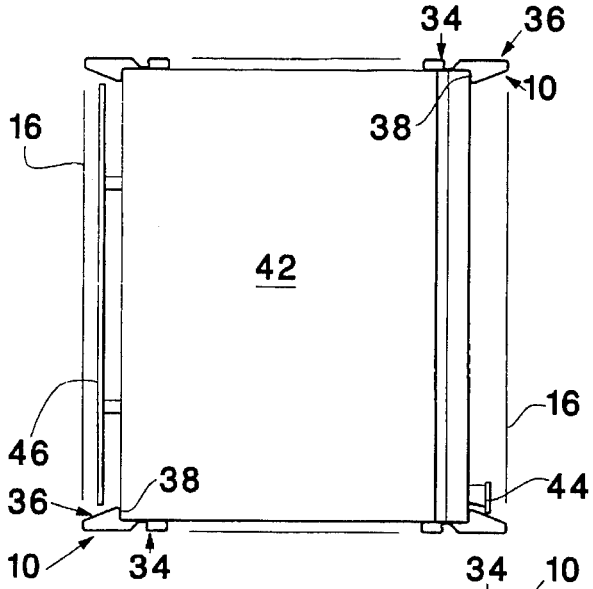
FIG. 5 is a schematic top view of a refrigerator with the corner post applied at all four corners thereof to protect both the forwardly directed handle and the rearwardly directed condenser.

Referring now more specifically to the drawings, FIG. 1 illustrates the hollow corner support post 10 of the invention stabilizing one corner of a packed appliance 12, for example a kitchen range with a forwardly projecting handle 14, within an encircling packaging sleeve 16, normally of corrugated cardboard or the like. The post 10, as seen in FIG. 2, is vertically elongate to preferably extends the full height of the product 12, and slightly therebeyond between a lower support platform and a top cap (not illustrated).

The corner post 10, preferably made from a convolutely wound paperboard tube transversely formed to the desired cross-sectional configuration, provides longitudinal compressive strength for stacking purposes and enhanced capability to cushion and accommodate lateral compressive forces. The post 10 also has the capability, in a unitary member, of accommodating projecting components or appliance portions beyond the basic planar sides thereof.

The corner post 10 includes inner and outer walls 18 and 20 longitudinally coextensive with each other and laterally spaced to define a space therebetween. These walls 18 and 20 are integrally joined by full length first and second end walls 22 and 24 of substantially equal width.

The outer wall 20, at a point spaced from the end wall 22, includes, along the full length of the post 10, a bead 26 extending inwardly into engagement with the inner surface of the inner wall 18 at an angle to a perpendicular line from the outer wall to the inner wall. The bead 26 includes opposed side panels 28 and 30 with one or both of the side panels inclined and defining the angle of the bead, as taught with regard to bead 26 in U.S. Pat. No. 5,267,651, to ensure a controlled collapsing of this section of the corner post 10 should a compressive loading greater than a predetermined compressive loading be applied thereagainst.

The outer wall 20, for the full extent thereof between the end walls 22 and 24, other than for the bead 26, is substantially planar. The inner wall 18, inwardly from the corresponding end wall 22 to a point either immediately beyond the apex portion 32 of the bead 26, as in FIG. 4, or in spaced relation therebeyond toward the end wall 24, as in FIG. 3, parallels the outer wall 20. The post 10, for the width thereof wherein the walls 18 and 20 are parallel to each other, and including the bead 26, comprises a first cushioning section 34 similar in structure and function to one leg of the "L" post of U.S. Pat. No. 5,267,651. While not normally considered necessary, more than one bead 26, extending from the same or the opposed wall, can be provided.

The corner post 10 includes a second extension section 36 beyond and in traverse alignment with the first section 34 throughout the full length of the post. This second section commences either at the far end of the apex 32 of the bead 26 relative to the end wall 22, as in FIG. 4, or therebeyond toward the end wall 24, as in FIGS. 1–3. The second section 36 is defined by a right angular shoulder 38 formed by the inner wall 18 and more particularly an intermediate portion thereof extending laterally at right angles to that portion of the inner wall 18 which parallels the outer wall 20. This shoulder or inner wall portion 38, at the outer edge thereof, is integral with a planar inner wall portion 40 which extends at an angle toward the outer wall for the remainder of the width of the corner post 10 and integrally joins the end wall 24. The second extension section 36 thus forms an elongate wedge configuration.

Noting FIGS. 3 and 4, it will be appreciated that the first section 34, while varying in width, is always of a width so as to accommodate the cushioning bead 26 at all stages of the cushioning action previously described in U.S. Pat. No. 5,267,651. The width of the second spacing or extension section 36 will vary in accord with the length of projection on the appliance which is to be accommodated.

Figure 6:
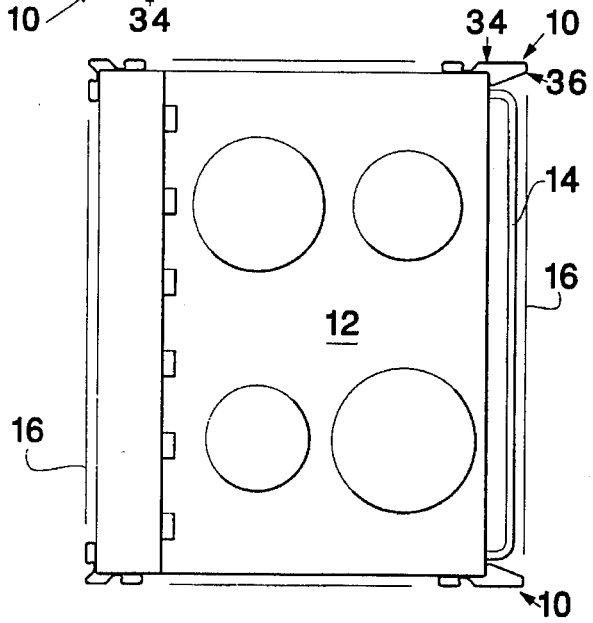
FIG. 6 is a schematic top view of a packaged range wherein two handle-protecting forward corner posts of the invention are combined with two rearward corner posts of the type in U.S. Pat. No. 5,267,651.
Figure 7:
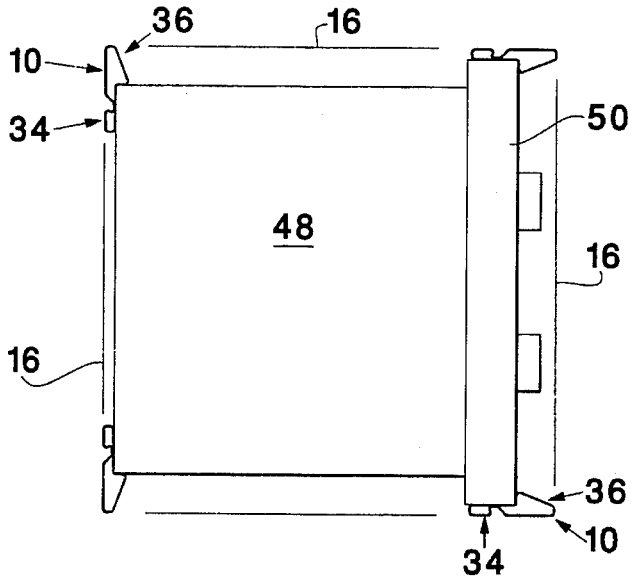
FIG. 7 is a schematic top view of a dishwasher with the corner posts of the invention protecting the forwardly directed handles and accommodating the normally narrower rear body portion.

With regard to the manner of use of the corner post 10, attention is directed to the schematic illustrations of FIGS. 5, 6 and 7. FIG. 5 illustrates, in plan view, a typical refrigerator 42 with a forwardly extending handle 44 and a rearward extending condenser 46. As such, the corner posts 10 of the invention will mount on the forward corners of the refrigerator with the second projecting or extension section 36 extending forwardly beyond the outer plane of the handle 44 for a distinct outward spacing of the protective sleeve 16 therefrom. Similar corner posts will be mounted on the rear corners of the refrigerator with the second extension sections thereof extending rearwardly beyond the condenser or condenser coils 46 for a similar outward spacing of the protective sleeve therefrom. The first cushioning section 34 of each of the corner posts utilized in FIG. 5 engages against the side wall of the body of the refrigerator 42 for protection thereof against lateral forces in the manner referred to prior patent U.S. Pat. No. 5,267,651.

FIG. 6, in plan view, illustrates the range 12, as in FIG. 1, wherein the corner posts 10 of the invention mount on the forward corners thereof with the second extension sections 36 extending forwardly beyond the range handle 14. As will be appreciated, while reference is made to a range handle 14, this could be any projecting components such as a control panel, oven handles, and the like. As will be recognized, the length of the sections can vary with the positioning of the sections being determined by the shoulder 38 which directly engages against the face of the appliance beyond which the extension section 36 is to extend.

With continued reference to FIG. 6, should the rear and side walls of the appliance contain no projections, it is preferred that the prior support posts of 5,267,651 be used at the rear corners to reduce the bulk of the package and provide the desired cushioning to both sides of the appliance within the enclosing cardboard sleeve 16.

FIG. 7 illustrates a typical built-in dishwasher 48 wherein the main body of the dishwasher rearward of the front door-mounting panel 50 is narrower than the front panel 50. As such, the corner posts 10 will mount on the rear corners with the second extension sections 36 directed to extend beyond the opposed sides a distance that is sufficiently beyond the opposed ends of the front panel 50 as to space the enclosing sleeve 16 outwardly therefrom. The cushioning first sections 34 of these rear posts will lie against the rear face of the appliance or dishwasher 48. Further, inasmuch as the face or front panel 50 will normally itself include projections, door handles, and the like thereon, the forward corner posts 10 will mount with the second extension sections 36 forwardly directed.

It will be appreciated that the second extension section 36 also provides a significant cushioning effect with the inclined inner wall portion 40 effectively transmitting any compressive forces on the corresponding end wall 24 to the body of the appliance. In addition, the inherent compressibility of the corner post allows for a slight movement of the appliance with the post to dissipate shocks. The supports, with the appliance corners seated within the right angular portions of the inner walls and with the inner walls stabilized by the bead, note in particular FIG. 1, have been found to provide a hammock-like support for the appliance.

While the extension section of the post is formed to accommodate substantial loads, particularly through the utilization of the inclined inner wall portion 40 which transfers the corner load at the end wall 24 to a substantially wider base defined by the appliance engaging lateral offset or shoulder 38, the packaging, as is common in appliance packaging, will normally designate the stronger faces as the lifting faces.

As desired, the corner post, usually just in the areas against which the painted surfaces of the appliance are to engage, may be coated with a polyethylene wax for protection of such surfaces.

From the foregoing, it will be appreciated that the corner posts 10 of the invention include a substantial degree of versatility and are capable of accommodating all normally encountered appliance configurations for the effective cushioning and protective enclosure thereof utilizing unitary structural members.

The foregoing is considered illustrative of the principles of the invention. It is to be appreciated that the embodiments specifically illustrated and described are not to be considered limitations on the invention, but are exemplary of the features of the invention, the scope of which is set forth in the claims following hereinafter.

I claim:

1. A corner support post for a product packaging system, said post having a length and a width defined by substantially coextensive first and second side walls laterally spaced from each other with a space therebetween, said post, across the width thereof, comprising first and second transversely aligned sections substantially coextensive along the length of said post, said first and second side walls having opposed longitudinal edges, first and second transverse end walls joining corresponding edges of said side walls and defining a first transverse outer end on said first section and a second transverse outer end on said second section, at least one bead integrally defined solely from one of said first and second side walls along the length of said first section, said bead extending from said one of said first and second side walls across said space and toward engagement with a second one of said first and second side walls in said first section, said space being interrupted solely by said bead, said bead, under predetermined compressive loading, resisting collapse of said side walls inward toward each other, said bead, upon compressive loading greater than said predetermined compressive loading, folding upon itself and defining multiple layers between said side walls, said first side wall being substantially planar for the width of said post, said first and second side walls being substantially parallel for the width of said first section, said second section including a shoulder thereon between said first and second outer ends and inward from said first end and toward said second end beyond a point of engagement of said bead with said second of said side walls, said bead extending at an angle inclined relative to said second section, said shoulder comprising a shoulder-defining portion of said second side wall extending laterally from that portion of said second side wall within said first section and defining a substantially right angle therewith, said shoulder-defining portion, at the outer extent thereof, being integral with a remaining portion of the width of said second side wall extending to said second transverse end wall, said remaining portion of said second side wall between said shoulder and said second end wall being planar, inclined at an acute angle to said shoulder and adapted to transmit compressive forces from said second end wall to a packaged product spaced from a corresponding corner of the product.

2. The corner support post of claim 1 wherein said first and second end walls are of substantially equal width between said first and second side walls.

3. The corner post of claim 2 wherein said at least one bead is defined from said first side wall.

4. The corner post of claim 3 wherein said bead is inclined away from said second section.

5. The corner post of claim 1 wherein said at least one bead is defined from said first side wall.

* * * * *